US007342553B2

(12) United States Patent
Soler Castany et al.

(10) Patent No.: US 7,342,553 B2
(45) Date of Patent: Mar. 11, 2008

(54) NOTCHED-FED ANTENNA

(75) Inventors: Jordi Soler Castany, Sant Cugat del Valles (ES); Carles Puente Baliarda, Sant Cugat del Valles (ES)

(73) Assignee: Fractus, S. A., Barcelona (ES)

( * ) Notice: Subject to any disclaimer, the term of this patent is extended or adjusted under 35 U.S.C. 154(b) by 0 days.

(21) Appl. No.: 11/033,788

(22) Filed: Jan. 12, 2005

(65) Prior Publication Data

US 2005/0116873 A1 Jun. 2, 2005

Related U.S. Application Data

(63) Continuation of application No. PCT/EP02/07837, filed on Jul. 15, 2002.

(51) Int. Cl.
*H01Q 21/00* (2006.01)

(52) U.S. Cl. ..... 343/853; 343/700 MS; 343/846; 343/702

(58) Field of Classification Search ..... 343/700 MS, 343/853, 846, 749, 830, 702
See application file for complete search history.

(56) References Cited

U.S. PATENT DOCUMENTS

| | | | | |
|---|---|---|---|---|
| 3,967,276 | A | 6/1976 | Goubau | |
| 4,072,951 | A | 2/1978 | Kaloi | |
| 4,155,089 | A * | 5/1979 | Kaloi | 343/700 MS |
| 4,197,544 | A * | 4/1980 | Kaloi | 343/700 MS |
| 4,723,305 | A | 2/1988 | Phillips et al. | |
| 5,227,808 | A | 7/1993 | Davis | |
| 5,410,322 | A | 4/1995 | Sonoda | 343/700 M |
| 5,847,682 | A | 12/1998 | Ke | |
| 5,943,020 | A | 8/1999 | Liebendoerfer | |
| 6,140,975 | A | 10/2000 | Cohen | |
| 6,157,348 | A | 12/2000 | Openlander | |
| 6,160,513 | A | 12/2000 | Davidson | |
| 6,211,825 | B1 * | 4/2001 | Deng | 343/700 MS |
| 6,337,662 | B1 | 1/2002 | Cassel | |
| 6,343,208 | B1 | 1/2002 | Ying | |
| 6,366,243 | B1 * | 4/2002 | Isohatala et al. | 343/700 MS |

(Continued)

FOREIGN PATENT DOCUMENTS

| | | |
|---|---|---|
| EP | 0 892 459 | 1/1999 |

(Continued)

OTHER PUBLICATIONS

H. Lebbar et al, "Analysis and Size Reduction of Various Printed Monopoles with Different Shapes", Electronic Letters, Oct. 13, 1994, vol. 30, No. 21, pp. 1725-1726.

(Continued)

*Primary Examiner*—Douglas W. Owens
*Assistant Examiner*—Ephrem Alemu
(74) *Attorney, Agent, or Firm*—Winstead PC

(57) ABSTRACT

A monopole or dipole antenna includes a radiating element having at least one notch. The at least one notch intersects at least at one point on an edge of the radiating element wherein the intersecting point is located at a distance to a feeding point. The distance being shorter than half a length of a longest edge of the radiating element. A maximum width of the at least one notch is narrower than a half of a longest length of the at least one notch.

22 Claims, 7 Drawing Sheets

U.S. PATENT DOCUMENTS

| | | | | |
|---|---|---|---|---|
| 6,421,014 | B1 | 7/2002 | Sanad | |
| 6,466,172 | B1 * | 10/2002 | Ryken et al. | 343/700 MS |
| 6,483,481 | B1 | 11/2002 | Sievenpiper et al. | |
| 6,518,931 | B1 | 2/2003 | Sievenpiper | |
| 6,545,647 | B1 | 4/2003 | Sievenpiper et al. | |
| 6,573,869 | B2 | 6/2003 | Moore | |
| 6,680,705 | B2 | 1/2004 | Tan | |
| 6,720,925 | B2 * | 4/2004 | Wong et al. | 343/700 MS |
| 6,727,857 | B2 | 4/2004 | Mikkola | |
| 6,759,989 | B2 | 7/2004 | Tarvas | |
| 6,759,991 | B2 | 7/2004 | Boyle | |
| 6,798,382 | B2 | 9/2004 | Edimo | |
| 6,876,329 | B2 * | 4/2005 | Milosavljevic | 343/700 MS |
| 7,015,868 | B2 | 3/2006 | Puente Baliarda | |
| 2004/0021605 | A1 | 2/2004 | Kouam | |

FOREIGN PATENT DOCUMENTS

| | | | |
|---|---|---|---|
| EP | 1018777 | A2 | 12/1999 |
| EP | 0 997 974 | | 5/2000 |
| EP | 1079462 | A2 | 6/2000 |
| EP | 1304765 | A2 | 10/2002 |
| EP | 1 265 369 | | 12/2002 |
| JP | 6252629 | | 9/1994 |
| JP | 09-051223 | | 2/1997 |
| JP | 2001251128 | | 9/2001 |
| WO | 0108257 | A1 | 2/2001 |
| WO | WO-01/22528 | | 3/2001 |
| WO | WO-01/54225 | | 7/2001 |
| WO | 0235652 | A1 | 5/2002 |
| WO | WO-03/041216 | | 5/2003 |
| WO | 03047025 | A1 | 6/2003 |

OTHER PUBLICATIONS

S.K. Palit et al, "Design of a Wideband Dual-Frequency Notched Microchip Antenna", IEEE, 1998, pp. 2351-2354.

J. Michael Johnson et al, "The Tab Monopole", IEEE Transactions on Antennas and Propagation, vol. 45, No. 1, Jan. 1997, pp. 187-188.

Wen-Shyang Chen et al, "Inset Microstripeline-Fed Circularly Polarized Microstrip Antennas", IEEE Transactions on Antennas and Propagation, vol. 48, No. 8, Aug. 2000, pp. 1253-1254.

Keith R. Carver et al, "Microstrip Antenna Technology", IEEE Transactions on Antennas and Propagation, vol. AP-29, No. 1, Jan. 1981, pp. 2-24.

James McLean et al, "Broadband, Robust, Low-profile Monopole Incorporating Top loading, Dielectric Loading, and a Distributed Capacitive Feed Mechanism", IEEE Antennas and Propagation Society, 1999 pp. 1562-1565.

A.G. Kandoian "Three New Antenna Types and Their Applications", Proc. IRE, vol. 34, pp. 70W-75W, Feb. 1946.

Kan et al., Small printed-wing antenna suitable for wireless handset terminals, Microwave and Optical Technology Letters, Aug. 2001, pp. 226-229, vol. 30, No. 4.

A. Shackelford et al., Simulation of a probe-fed notched patch antenna with a shorting post, IEEE Antennas and Propagation Society International Symposium, Jul. 2001.

Kim et al., Dual-frequency aperture-coupled square patch antenna with double notches, Microwave and Optical Technology Letters, Mar. 2000, vol. 24, No. 6.

Lu et al. A broadband patch antenna with wide slits, IEEE Antennas and Propagation Society International symposium, 2000.

Wong, Compact and broadband microstrip antennas, A Wiley-Interscience Publication, 2002.

Yang, Dual.band circularly-polarized square microsrip antenna, IEEE Transactions on Antennas and Propagation, 2001, vol. 49, No. 3.

Jiang, Optimization of circular polarized patch antenna with cross-shaped slit, IEEE Antennas and Propagation Society International Symposium, 2002.

Omar, A new broad-band, dual-frequency coplanar waveguide fed slot-antenna, Antennas and propagation society international symposium, 1999.

Jofre, Miniature multielement antennas for diversity wireless communications, International Conference on Electromagnetics in Advance Applications (ICEAA), 2001.

Wong, Planar antennas for wireless communications, Wiley, 2003.

Lu, Slot-loaded, meandered rectangular microstrip antenna with compact dual-frequency operation, Electronic Letters, May 1998, vol 34, No. 11.

Palit, Design of a wideband dual-frequency notched microstrip antenna, IEEE APS, 1998.

Maci et al. Dual-frequency patch antennas, IEEE Antennas and Propagation Magazine, Dec. 1997, vol. 39, No. 6.

Wong et al. Internal GSM/DCS antenna backed by a step-shaped ground plane for a PDA phone, IEEE Transactions on Antennas and Propagation, Aug. 2006.

Lu, Single-feed dual-frequency rectangular microstrip antenna, IEEE Antennas and Propagation Society International Symposium, Jul. 2000.

* cited by examiner

Fig. 4A
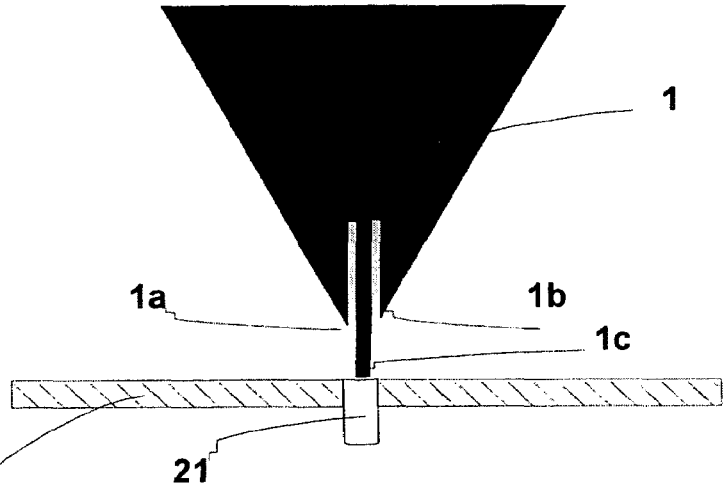
Fig. 4B
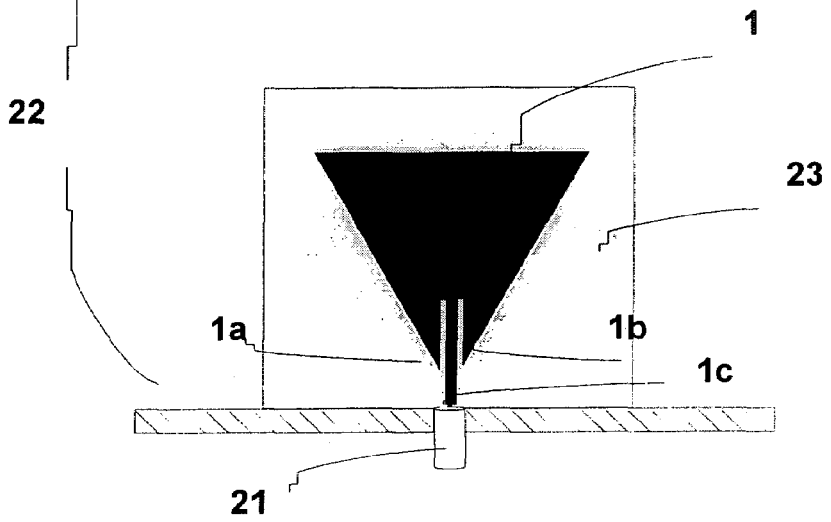
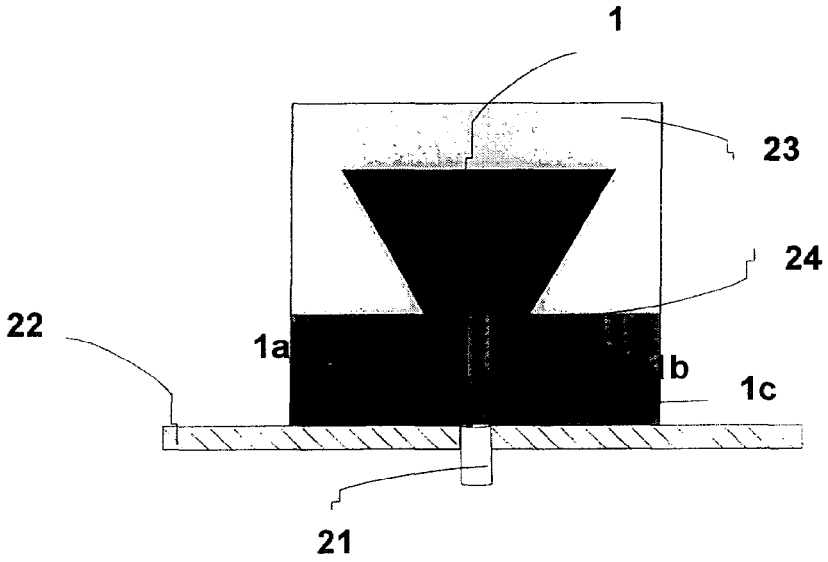
Fig. 4C

FIG-6A
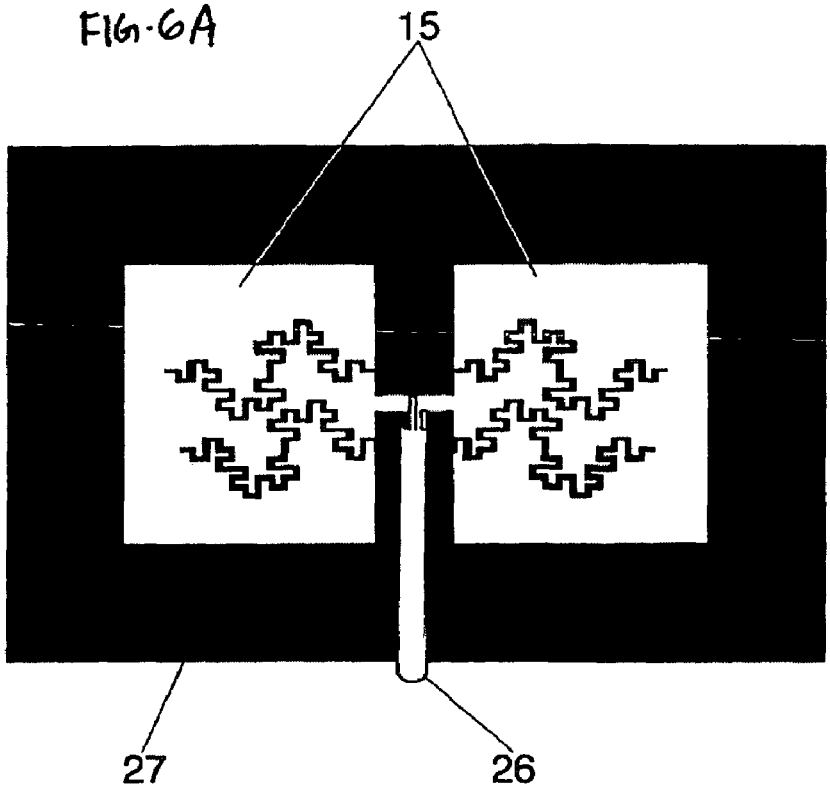
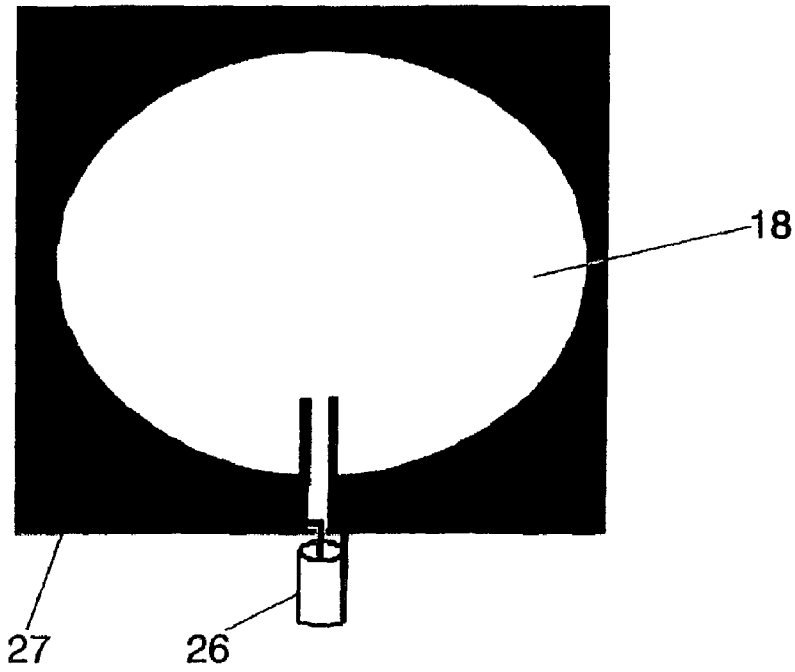
FIG.6B

NOTCHED-FED ANTENNA

This application is a continuation of PCT/EP02/07837 filed Jul. 15, 2002.

BACKGROUND OF THE INVENTION

1. Technical Field of the Invention

The present invention relates to a novel notched-fed antenna which features a smaller size with respect to prior art antennas, a multifrequency behavior or a combination of both effects.

The radiating element of the novel notched-fed antenna consist of a polygonal, multilevel or loaded shape and a set of notches inserted next to the feeding zone of said polygonal, multilevel structures or loaded shapes.

The invention refers to a new type of notched-fed antenna which is mainly suitable for mobile communications or in general to any other application where a compact, small or multiband antenna is required.

2. Description of Related Art

The growth of the telecommunication sector, and in particular, the expansion of personal mobile communication systems are driving the engineering efforts to develop multiservice (multifrequency) and compact systems which require multifrequency and small antennas. Therefore, the use of a multisystem small antenna, which provides coverage of the maximum number of services, is nowadays of notable interest since it permits telecom operators to reduce their costs and to minimize the environmental impact.

A variety of techniques used to reduce the size of the antennas can be found in the prior art. A. G. Kandoian (A. G. Kandoian, "Three new antenna types and their applications, Proc. IRE, vol. 34, pp. 70W-75W, February 1946) introduced the concept of loaded antennas and demonstrated how the length of a quarter wavelength monopole can be reduced by adding a conductive disk at the top of the radiator. Other top-loaded antennas were introduced by Goubau, as it is illustrated in U.S. Pat. No. 3,967,276, or described in U.S. Pat. No. 5,847,682 entitled "Top loaded triangular printed antenna". However, in all these prior art solutions the basis of the mechanism of how the antenna size is reduced can be found in the capacitive component introduced by the addition of the loading structure at the top of the radiating element. In contrast, the present invention discloses a new mechanism for reducing the antenna size and obtain a multiband behavior.

J. McLean ("Broadband, robust, low profile monopole incorporating top loading, dielectric loading, and a distributed capacitive feed mechanism", Antennas and Propagation Society, 1999. IEEE International Symposium 1999, vol. 3, pp. 1562-1565) describes a top-loaded antenna which includes a capacitive feed.

Some previously reported dual-band antennas use a spur line filter which may be partially similar in shape to the present invention. However, this previous solution is used for patch antennas, which have both, a configuration and radiation mechanism, different from a monopole or dipole antenna, which are considered in the present invention.

Two other different alternatives to achieve an antenna with a multiband and/or small size performance are multilevel antennas, Patent WO0122528 entitled "Multilevel Antennas", and miniature space-filling antennas, Patent WO0154225 entitled "Space-filling miniature antennas".

SUMMARY OF THE INVENTION

The key point of the invention is the shape of the radiating element which includes a set of notches inserted on the edge of the radiating element and located at a distance to the feeding point, said distance being shorter than a half of the longest edge of the said radiating element, and wherein the maximum width of said notch or notches is smaller than a half of the longest length of said notches. According to the present invention the antenna is a monopole or a dipole which includes at least one notch. Also, in some embodiments the antenna includes multiple notches with different shapes and lengths in a radiating element shaped by means of a polygonal, multilevel or loaded structure. From the perspective of the present invention, circular or elliptical shapes are considered polygonal structures with a large number of sides. In this case, the longest edge is considered as a quarter of the perimeter of the circular or elliptical shape.

Due to the addition of the notches in the vicinity of the feeding point, the antenna features a small size, a multiband behavior, a wideband behavior or a combination of said effects.

The novel monopole or dipole antenna can include one, two or more notches, which can be inserted either at one side of the feeding point or at both sides of the feeding point.

The notched-fed antenna can include one notch intersecting itself at one point. Also, the antenna can include at least two notches which intersect one with the other at least at one point.

The notches included in the radiating element can be shaped using a space-filling curve or using a curve composed by a minimum of two segments and a maximum of nine segments which are connected in such a way that each segment forms an angle with their neighbors, wherein, no pair of adjacent segments define a longer straight segment.

The main advantage of this novel notched-fed antenna with respect to prior-art antennas is two-folded.

The antenna features a small performance, a multiband behavior, wideband behavior or a combination of said effects.

Given the physical size of the radiating element including the notches, said antenna can be operated at a lower frequency than most of the prior art antennas.

BRIEF DESCRIPTION OF THE DRAWINGS

A more complete understanding of the apparatus of the present invention may be acquired by reference to the following Detailed Description when taken in conjunction with the accompanying Drawings wherein:

FIGS. 4A-4C show three particular cases of notched-fed monopole according to embodiments of the present invention;

FIG. 6A shows a dipole antenna including two notches according to an embodiment of the present invention;

FIG. 6B shows an aperture antenna according to an embodiment of the present invention.

DETAILED DESCRIPTION OF THE DRAWINGS

Figure 1A:
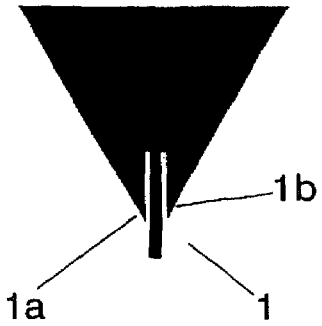
FIGS. 1A-1L show some examples of the radiating element for a notched-fed antenna according to embodiments of the present invention.
Figure 1B:
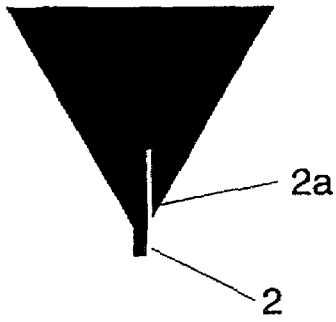
Figure 1C:
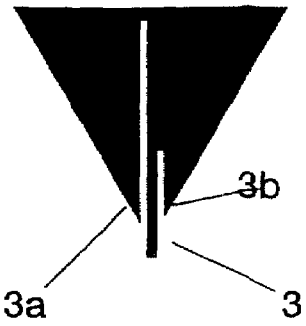
Figure 1D:
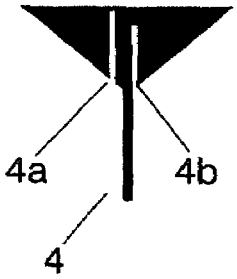
Figure 1E:
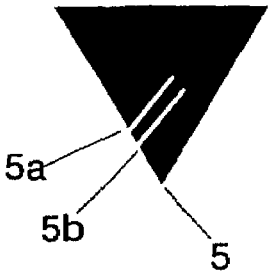
Figure 1F:
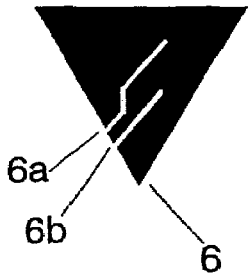
Figure 1G:
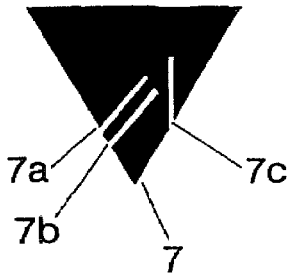
Figure 1H:
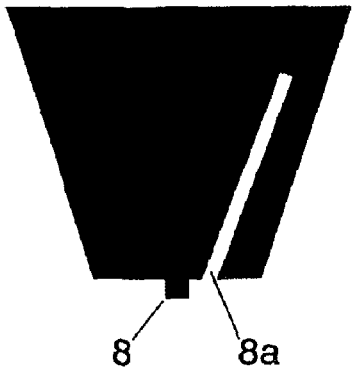
Figure 1I:
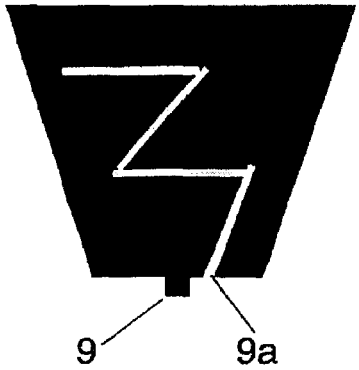
Figure 1J:
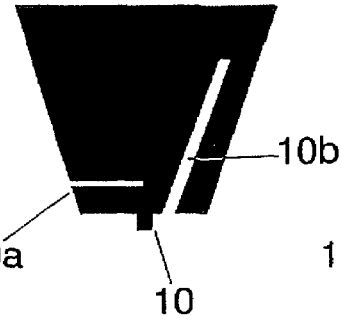
Figure 1K:
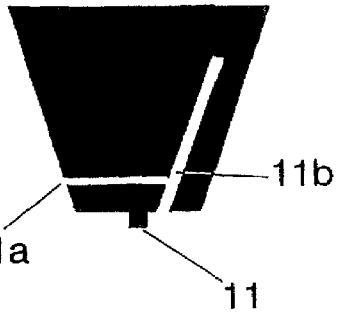
Figure 1L:
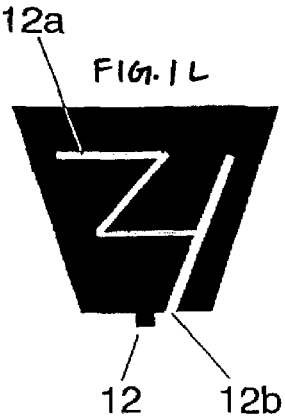

FIGS. 1A-1F show an antenna including several notches in different configurations for two different structures; those are, a triangle and a trapezoid. In FIG. 1A, the radiating element includes two identical notches (1*a*) and (1*b*), while in FIG. 1B the radiating element only includes one notch (2*a*). FIG. 1C represents a more general example of an antenna with two notches (3*a*) and (3*b*) with different lengths. FIGS. 5A-B, 6A-B, and 7 describe three examples where the distance from the feeding point to the location of the notches is larger than in the previous cases. FIGS. 6A-6B include two notches (6*a*) and (6*b*) with different lengths and shapes. FIGS. 1H-1L show a notched-fed antenna where the radiating element is a trapezoid structure. In FIG. 1I, the antenna includes one notch, which is a curve composed by four segments which are connected in such a way that each segment forms an angle with their neighbours, and wherein, no pair of adjacent segments define a larger straight segment. FIG. 1K shows a notched-fed antenna with two notches (11*a*) and (11*b*), which intersect at one point. In any of the embodiments in FIGS. 1A-1L, the notch intersects the perimeter of the radiating arm of the monopole at a point located at a distance from the feeding point which is shorter than half of the longest edge of the perimeter of said radiating arm, according to the present invention. Also, in any case the width of the notch is narrower than half of its length, according to the present invention.

Figure 2A:
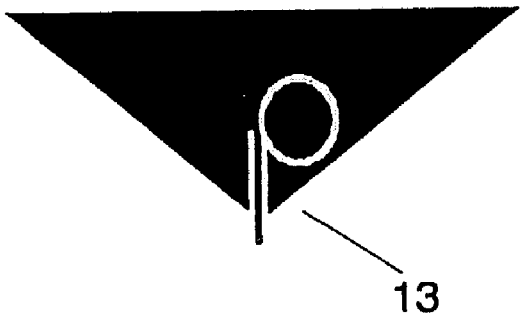
FIGS. 2A-2F show new configurations of the notched-fed antenna according to embodiments of the present invention.
Figure 2B:
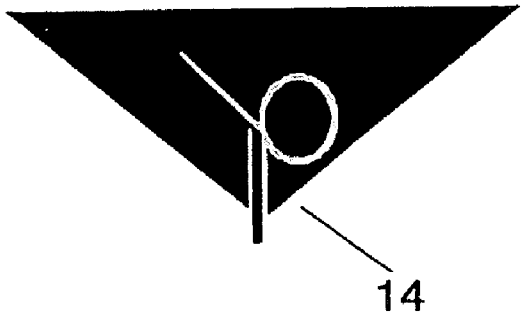
Figure 2C:
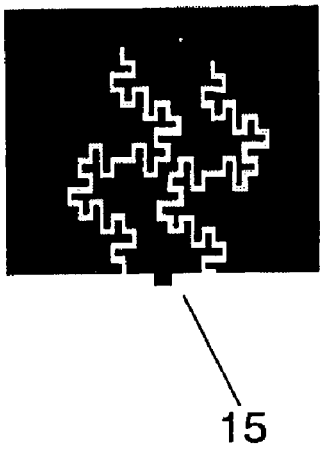
Figure 2D:
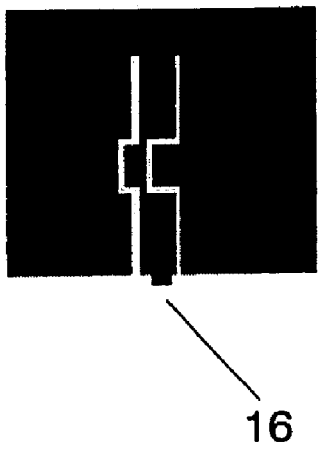
Figure 2E:
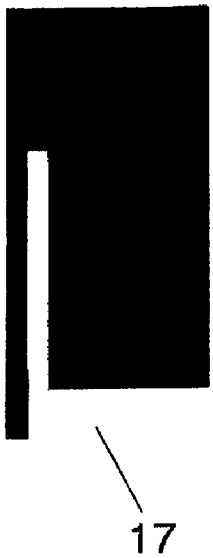
Figure 2F:
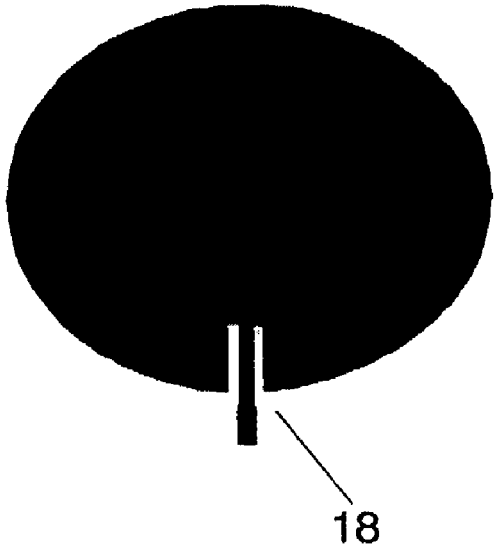

FIGS. 2A-2F show three new configurations of the notched-fed antenna. FIGS. 2A and 2B show an example of antenna with two different notches, being one of the notches shaped as a curve which intersects itself one point. FIG. 2C is an antenna with two different notches shaped with two different space-filling curves. FIG. 2D describes an antenna with two different notches shaped as a curve similar to the curve described in FIG. 1I. Finally, FIGS. 2E and 2F describe two other examples of notched-fed antenna. FIG. 2F shows an elliptical radiating element with two identical notches.

Figure 3A:
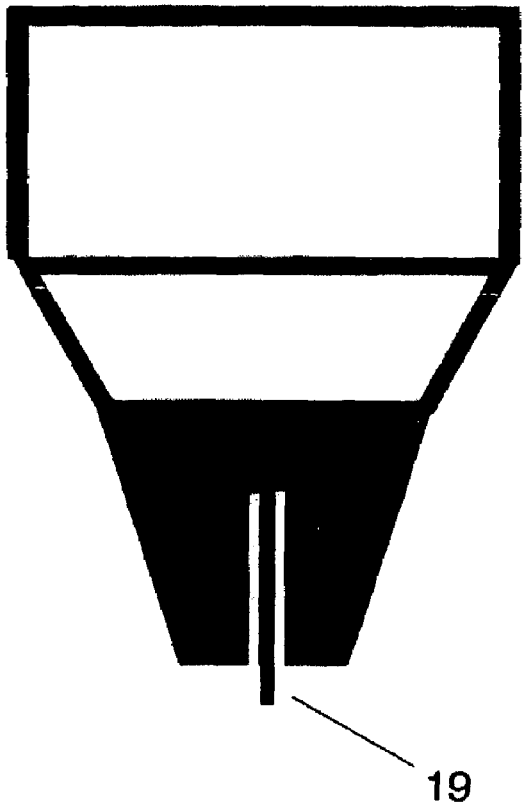
FIG. 3A shows a loaded radiating element according to an embodiment of the present invention.
Figure 3B:
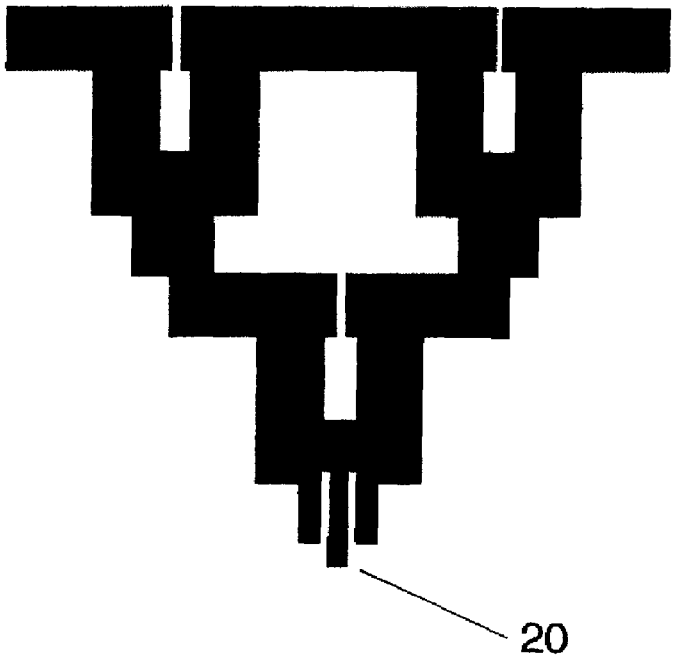
FIG. 3B shows a multilevel radiating element according to an embodiment of the present invention.

FIG. 3A describes a loaded radiating element with two inserted notches, while FIG. 3B shows a multilevel radiating element including two notches in a similar configuration to FIG. 3A.

FIGS. 4A-4C show three particular cases of notched-fed monopole. They consist of a monopole comprising a conducting or superconducting ground plane with an opening to allocate a coaxial cable (21) with its outer conductor connected to said ground plane and the inner conductor connected to the notched-fed antenna. The radiating element can be optionally placed over a supporting dielectric (23) and include a second parallel conductor (24).

Figure 5A:
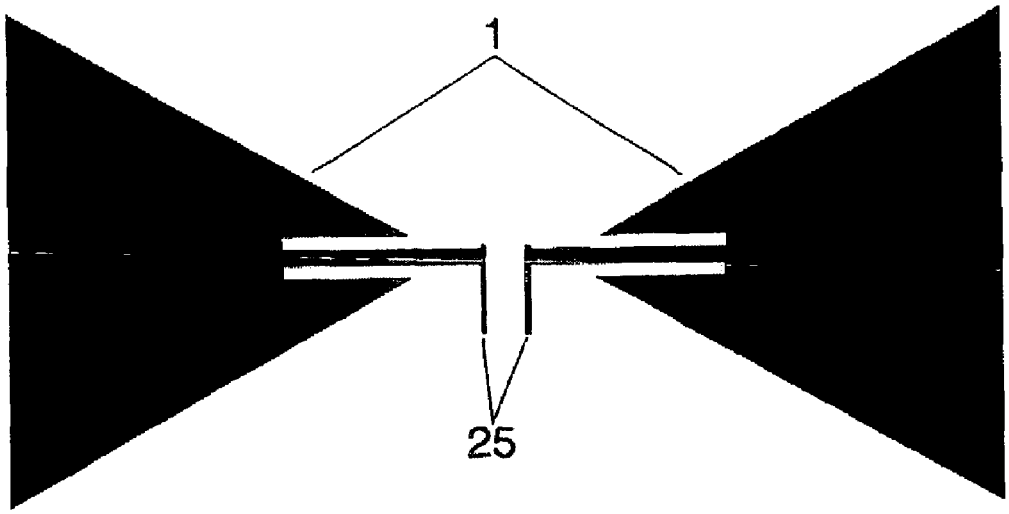
FIGS. 5A-5B show a notched-fed antenna according to embodiments of the present invention.
Figure 5B:
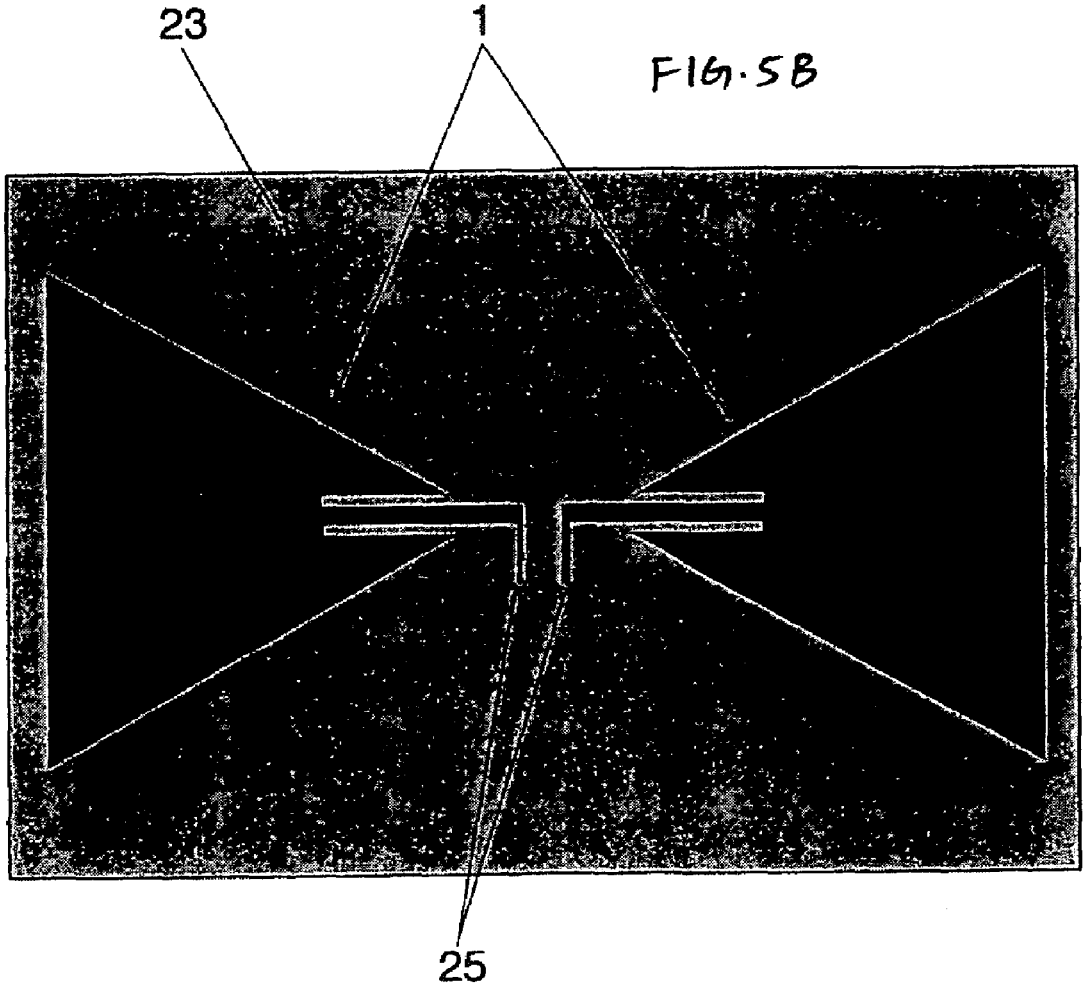

FIGS. 5A-5B show a notched-fed antenna consisting of a dipole wherein each of the two arms includes two notches. The lines at the vertex of the small triangles (25) indicate the input terminal points. FIGS. 5A-5B display different configurations of the same basic dipole; in the lower drawing the radiating element is supported by a dielectric substrate (23).

FIGS. 6A-6B shows in the upper drawing, an example of a dipole antenna including two notches shaped as space-filling curves at each antenna arm but fed as an aperture antenna. The lower drawing shows another aperture antenna, wherein the aperture (18) is practiced on a conducting or superconducting structure (27), said aperture being shaped as an elliptical structure including two notches.

A preferred embodiment of the notched-fed monopole antenna is shown in FIGS. 4A-4C. The radiating element includes two notches (1*a*) and (1*b*) with the same shape, each one inserted at one point on the edge of the radiating element. Particularly, both notches are located at a distance to the feeding point (1*c*) shorter than a half of the longest edge of the radiating element and where the maximum width of both notches is smaller than a half of the longest length of the notches. Moreover, one notch is inserted at one side of the feeding point, and the other is inserted at the opposite side with respect to the feeding point. The monopole includes a conducting or superconducting counterpoise or ground plane (22). A handheld case, or even a part of the metallic structure of a car or train can act as such a ground counterpoise. The ground and the monopole arm (1) are excited as usual in prior art monopole by means of, for instance, a transmission line (21). Said transmission line is formed by two conductors, one of the conductors connected to the ground plane our counterpoise while the other is connected to a point of the conducting or superconducting notched-fed antenna. In FIGS. 4A-4C, a coaxial cable (21) has been taken as particular case of transmission line, but it is clear to any skilled in the art that other transmission lines (such as for instance a microstrip arm) could be used to excite the monopole. Optionally, and following the scheme just described, the notched-fed monopole can be printed, for instance, over a dielectric substrate (23). Also, the notched-fed monopole can include a second conductor (24) parallel to the radiating element and located from the radiating element a distance smaller than a quarter of the longer operating wavelength. The space between the radiating element and the second conductor (24) can be filled with air, dielectric or a combination of both.

FIG. 5A describes a preferred embodiment of the invention. A two-arm notched-fed dipole antenna is constructed comprising two conducting or superconducting parts, each part being a notched-fed structure. The dipole includes two identical notches, but optionally, it could include only one notch. For the sake of clarity but without loss of generality, a particular case of the notched-fed dipole (1) has been chosen here; obviously, other structures, as for instance, those described in FIGS. 1A-1L, could be used instead. The two closest apexes of the two arms form the input terminals (25) of the dipole. The terminals (25) have been drawn as conducting or superconducting wires, but as it is clear to those skilled in the art, such terminals could be shaped following any other pattern as long as they are kept small in terms of the operating wavelength. The skilled in the art will notice that, the arms of the dipoles can be rotated and folded in different ways to finely modify the input impedance, the radiation parameters of the antenna such as, for instance, polarization, or both features.

Another preferred embodiment of a notched-fed dipole is also shown in FIG. 5B where the notched-fed arms are printed over a dielectric substrate (23); this method is particularly convenient in terms of cost and mechanical robustness when the shape of the radiating element contains a high number of polygons, as happens with multilevel structures. Any of the well-known printed circuit fabrication techniques can be applied to pattern the notched-fed structure over the dielectric substrate. Said dielectric substrate can be, for instance, a glass-fibre board (FR4), a teflon based substrate (such as Cuclad®) or other standard radiofrequency and microwave substrates (as for instance Rogers 4003® or Kapton®). The dielectric substrate can be, for instance, a portion of a window glass if the antenna is to be mounted in a motor vehicle such as a car, a train or an airplane, to transmit or receive radio, TV, cellular telephone (GSM900, GSM1800, UMTS) or other communication services electromagnetic waves. Of course, a balun network can be connected or integrated in the input terminals of the dipole to balance the current distribution among the two dipole arms.

The first embodiment as shown in FIG. 6A consist of an aperture configuration of a notched-fed antenna using two space-filling curves for the notches. The feeding techniques can be one of the techniques usually used in conventional aperture antennas. In the described figure, the inner conductor of the coaxial cable (26) is directly connected to one side of the strip connected to the square-shaped radiating element and the outer conductor to the other side of the said strip. Other feeding configurations are possible, such as for instance a capacitive coupling. FIG. 6A further shows an empty part (15) of the antenna. The empty part 15 may be for example, air or filled with a dielectric material.

Another preferred embodiment of the notched-fed antenna is a notched-fed aperture antenna as shown in FIG. 6B. In this figure the notched-fed elliptical structure (18) is impressed over a conducting or superconducting sheet (27). Such sheet can be, for instance, a sheet over a dielectric substrate in a printed circuit board configuration, a transparent conductive film such as those deposited over a glass window to protect the interior of a car from heating infrared radiation, or can even be a part of the metallic structure of a handheld telephone, a car, train, boat or airplane. The feeding scheme can be any of the well known in conventional slot antenna and it does not become an essential part of the present invention. In all said two illustrations in FIGS. 6A-6B, a coaxial cable has been used to feed the antenna, with one of the conductors connected to one side of the conducting sheet and the other connected at the other side of the sheet across the slot. A microstrip transmission line could be used, for instance, instead of a coaxial cable.

Figure 7:
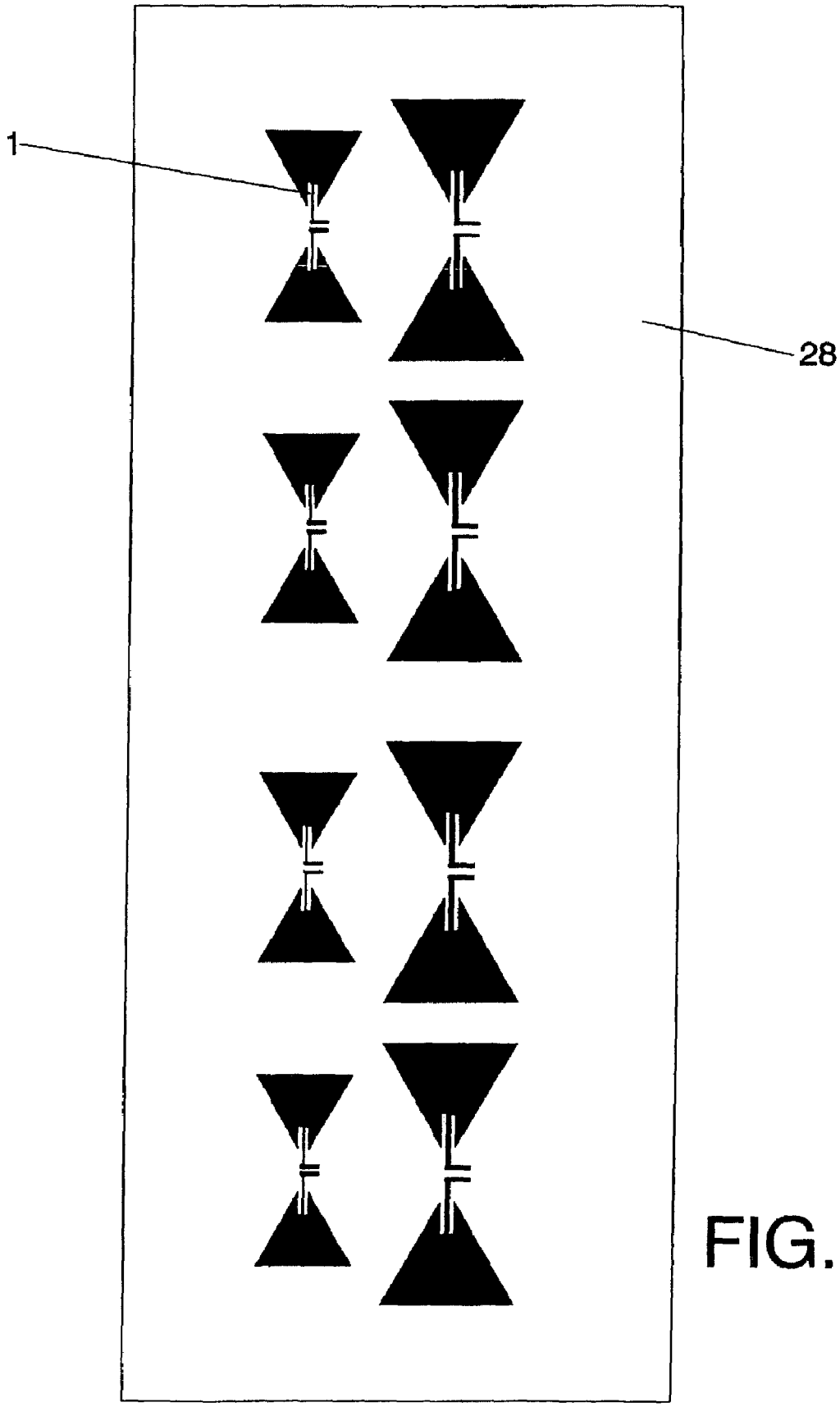
FIG. 7 shows an antenna array including notched-fed radiating elements according to an embodiment of the present invention.

FIG. 7 describes another preferred embodiment. It consists of an antenna array (28) which includes a notched-fed dipole antenna (1).

The invention claimed is:

1. An antenna comprising:

a radiating element including at least one notch that intersects at least at one point on an edge of said radiating element and at least a portion of said radiating element includes a multilevel structure, said intersecting point is located at a distance to a feeding point that is shorter than half a length of the longest edge of said radiating element; and wherein the maximum width of said at least one notch is narrower than half of the length of said at least one notch and said antenna features a similar radiation pattern and input impedance at more than one frequency band.

2. The antenna according to claim 1, wherein the radiating element includes one notch.

3. The antenna according to claim 1, wherein the radiating element includes two notches.

4. The antenna according to claim 1, wherein the radiating element includes two notches, a first notch is inserted at one side of the feeding point, and a second notch is inserted at an opposite side of the feeding point.

5. The antenna according to claim 4, wherein the two notches have similar shapes.

6. The antenna according to claim 1, wherein the radiating element includes at least a first notch and a second notch, said second notch is different in shape from said first notch, being such difference in length, shape or both.

7. The antenna according to claim 1, wherein the antenna includes at least one notch shaped as a curve intersecting itself at least at one point.

8. The antenna according to claim 1, wherein the antenna includes at least two notches, said at least two notches intersecting each other at least at one point.

9. The antenna according to claim 1, wherein a perimeter of said radiating element is a shape chosen from the following set: triangular, square, rectangular, trapezoidal, pentagonal, hexagonal, heptagonal or octagonal.

10. The antenna according to claim 1, wherein a perimeter of said radiating element has a circular or elliptical shape, and for the circular or elliptical shape, the longest edge is considered as a quarter of the perimeter of the circular or elliptical shape.

11. The antenna according to claim 1, wherein the at least one notch is a curve composed by a minimum of two segments and a maximum of nine segments which are connected in such a way that each segment forms an angle with their neighbors and no pair of adjacent segments define a larger straight segment.

12. The antenna according to claim 1, wherein a shape of at least a portion of the at least one notch is a space-filling curve.

13. The antenna according to claim 1, wherein the radiating element includes at least a second conductor parallel to the radiating element, said second conductor being located at a distance from the radiating element smaller than a quarter of a central operating wavelength, and a space between the radiating element and said second conductor is filled with air or a dielectric or a combination of both.

14. The antenna according to claim 1, wherein said antenna is an element of an antenna array, said array including at least a notched-fed antenna.

15. The antenna according to claim 1, wherein the antenna is shorter than a quarter of a central operating wavelength.

16. The antenna according to claim 1, wherein the antenna includes a conducting or superconducting ground-plane.

17. The antenna according to claim 16, wherein the ground-plane is part of a handled case.

18. The antenna of claim 17, wherein the antenna is suitable for mobile communications and is placed inside a cellular phone or handheld wireless terminal.

19. The antenna of claim 17, wherein the antenna is excited by means of a transmission line, said transmission line including first and second conductors, said first conductor being connected to the ground-plane, and said second conductor being connected to a point of the radiating element.

20. The antenna according to claim 17, wherein the radiating element is printed over a dielectric substrate.

21. The antenna according to claim 20, wherein the dielectric substrate is part of the metallic structure of a handled telephone.

22. The antenna according to claim 20, wherein the antenna is adapted to transmit or receive electromagnetic waves of radio, or TV, or cellular telephone in the bands GSM 900, GSM 1800 or UMTS.

* * * * *